US007938523B2

(12) United States Patent
Aldrich

(10) Patent No.: US 7,938,523 B2
(45) Date of Patent: May 10, 2011

(54) FLUID SUPPLY TANK VENTILATION FOR A MICRO-FLUID EJECTION HEAD

(75) Inventor: Charles Stanley Aldrich, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 998 days.

(21) Appl. No.: 11/762,101

(22) Filed: Jun. 13, 2007

(65) Prior Publication Data

US 2008/0309740 A1 Dec. 18, 2008

(51) Int. Cl.
*B41J 2/19* (2006.01)
*B41J 2/175* (2006.01)

(52) U.S. Cl. ..... 347/92; 347/84; 347/85; 347/86; 347/89; 347/93

(58) Field of Classification Search ..... 347/86, 347/92

See application file for complete search history.

(56) References Cited

U.S. PATENT DOCUMENTS 5,216,450 A * 6/1993 Koitabashi et al. ..... 347/87
5,504,511 A * 4/1996 Nakajima et al. ..... 347/86
5,703,633 A * 12/1997 Gehrer et al. ..... 347/86
5,721,577 A * 2/1998 Ostermeier et al. ..... 347/86
5,801,737 A * 9/1998 Sato et al. ..... 347/86
5,877,794 A * 3/1999 Takagi ..... 347/87
5,903,293 A * 5/1999 Nikkels et al. ..... 347/86
5,905,518 A * 5/1999 DeFilippis ..... 347/85
5,953,030 A * 9/1999 Ishinaga et al. ..... 347/86
5,988,803 A * 11/1999 Komplin et al. ..... 347/86
6,250,749 B1 * 6/2001 Merz et al. ..... 347/86
6,254,226 B1 * 7/2001 Lengyel et al. ..... 347/86
6,270,207 B1 * 8/2001 Sasaki ..... 347/86
6,280,024 B1 * 8/2001 Miyazawa et al. ..... 347/86
6,502,933 B2 * 1/2003 Lim et al. ..... 347/86
6,550,900 B2 * 4/2003 Chan et al. ..... 347/86
6,585,360 B1 * 7/2003 Dietl ..... 347/86
6,880,921 B2 * 4/2005 Aponte et al. ..... 347/86
7,114,801 B2 * 10/2006 Hall et al. ..... 347/92
7,255,431 B2 * 8/2007 Lui ..... 347/86
2008/0165214 A1 * 7/2008 Yuen ..... 347/7

* cited by examiner

*Primary Examiner* — Ryan Lepisto

(57) ABSTRACT

An improved fluid supply tank for a micro-fluid ejection head and method for improving operation of a micro-fluid ejection device. The fluid supply tank has a body portion for holding a fluid to be ejected. The body portion includes a fluid exit port on an exit end thereof and a cover on an opposing end thereof. An internal vent conduit is disposed in the tank between the exit end and the cover for air removal adjacent to the exit port.

18 Claims, 8 Drawing Sheets

56
54
52

FLUID SUPPLY TANK VENTILATION FOR A MICRO-FLUID EJECTION HEAD

FIELD OF THE DISCLOSURE

The present disclosure is generally directed toward micro-fluid ejection heads and to fluid supply components for ejection heads. In particular, the disclosure relates to structures for improving venting of fluid supply tanks for micro-fluid ejection heads.

BACKGROUND AND SUMMARY

Micro-fluid ejection heads are useful for ejecting a variety of fluids including inks, cooling fluids, pharmaceuticals, lubricants and the like. A widely used micro-fluid ejection head is in an ink jet printer. As the fluid droplet size and speed of fluid ejection increases, factors that effect fluid ejection are magnified requiring solutions to problems that previously did not exist.

Micro-fluid ejection devices, such as ink jet printers, with replaceable fluid supply tanks may have or develop a problem of trapping air adjacent to a connection between the fluid supply tank and an ejection head structure. Trapped air may also be confined in an intermediate area between a fluid flow path from the fluid supply in a cartridge or tank and the ejection head structure. Expansion and/or contraction of the trapped air as the result of atmospheric pressure or altitude changes may result in changes in pressure of the fluid at nozzles in the ejection head. Such pressure changes or air expansion may result in seepage of fluid from the nozzles when the nozzles are exposed to less than atmospheric pressure or air intake into the nozzles when there is a negative pressure in the ejection head adjacent to the nozzles.

When the fluid supply container is removably attached to a permanent or semi-permanent ejection head structure, there are additional concerns with regard to trapping air. Typically, during the attachment or removal of a fluid supply tank onto a permanent or semi-permanent micro-fluid ejection head, there may be an air space or volume of air in an exit port of the fluid supply tank and/or flow features in the ejection head. A change in air volume may result from the displacements encountered in the process of exchanging fluid supply tanks and such volume change may cause seepage of fluid from the ejection head nozzles or air ingestion at the nozzles. For proper or prolonged operation of the ejection head, it is desirable to avoid both of these situations.

In a multi-fluid supply tank having ejection heads that eject multiple different fluids, such as different colored inks, for example, seepage of fluid from the nozzles may result in cross-contamination of fluids. Some fluid containers include a relatively large breathing mechanism (a spring loaded air bag within the tank, for example) and relatively large air storage volumes to retain and accommodate ingested air and volume changes due to pressure changes. In other instances, a purging pump may be used to remove air through the nozzles of the ejection head. When a purging pump is used, the ejection head is moved to a maintenance station where purging of air may occur.

The removal of air from the fluid storage tanks becomes even more critical as the size of the storage tanks is decreased relative to an amount of fluid contained in the storage tank. In larger fluid storage tanks, an excess volume is available for reducing the effects of air volume changes in the tank. However, smaller tanks having the same volume of fluid as larger tanks are less tolerant of air volume changes. Also, it is not desirable, from a cost point of view, to provide an air purging pump system to remove air from the fluid storage tanks. Accordingly, there is a need for a more cost effective device to remove air from fluid storage tanks for micro-fluid ejection devices.

In view of the foregoing needs, one embodiment of the disclosure provides a fluid supply tank for a micro-fluid ejection head. The fluid supply tank has a body portion for holding a fluid to be ejected. The body portion includes a fluid exit port on an exit end thereof and a cover on an opposing end thereof. An internal vent conduit is disposed in the tank between the exit end and the cover for air removal adjacent the exit port.

Another embodiment of the disclosure provides a method for enhancing the operation of a micro-fluid ejection device. The method includes, disposing an internal vent conduit in a fluid supply container for the micro-fluid ejection device. The vent conduit is disposed between a fluid exit end of the container and a container cover opposite the fluid exit end. The fluid supply container is installed on the micro-fluid ejection device so that any trapped air between the container and the device is urged through the internal vent conduit through an atmospheric vent in the cover.

The exemplary embodiments disclosed herein may mitigate the above described problems by providing a vent path in an interior portion of the fluid supply tank between the cover and the fluid exit port of the fluid supply tank. The vent may be effective for venting air adjacent the outlet port when the outlet port is sealed, in the case of a removable fluid supply tank or may be effective to remove air from fluid supply paths in an ejection head for a disposable fluid supply tank and ejection head. Removal of air is important to prevent unwanted or untimely loss of fluid from the fluid storage tank as a result of atmospheric pressure changes that may expand or contract any air bubbles inside the tank.

Exemplary embodiments may avoid having to configure ejection head tanks with large air collection volumes or having to incorporate into the fluid ejection devices such as printers, air removal mechanisms or purge maintenance stations. Another advantage of the ventilation path may be that the path allows fluid to be absorbed into the felts rather than retained in the fluid exit port of the tank. Trapped air that expands adjacent to the fluid exit port may be effectively removed using the ventilation path provided in the tank.

BRIEF DESCRIPTION OF THE DRAWINGS

Further advantages of exemplary embodiments disclosed herein may become apparent by reference to the detailed description of the embodiments when considered in conjunction with the drawings, which are not to scale, wherein like reference characters designate like or similar elements throughout the several drawings as follows.

DESCRIPTION OF THE EXEMPLARY EMBODIMENTS

Figure 1:
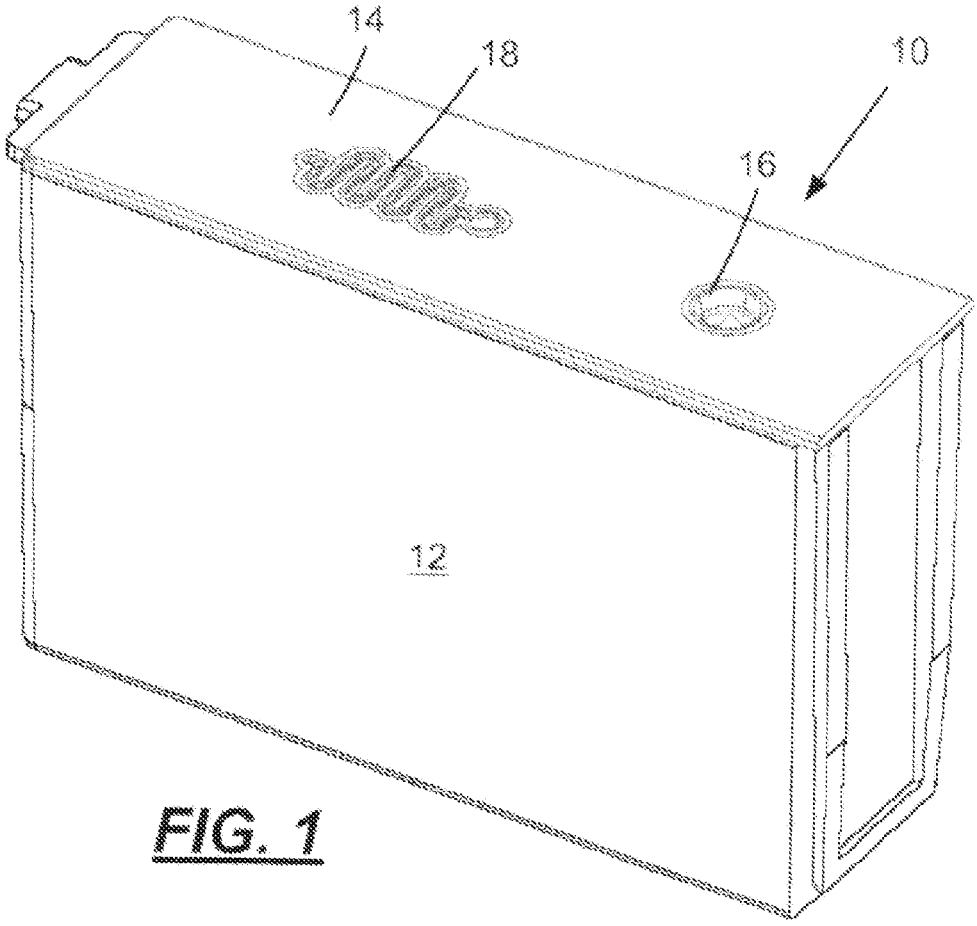
FIG. 1 is a perspective view, not to scale, of a removable fluid supply tank for a micro-fluid ejection device.
Figure 2:
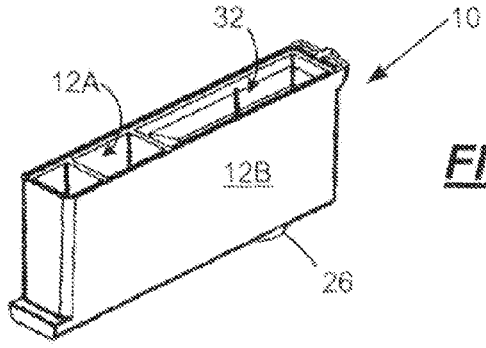
FIG. 2 is a perspective view, not to scale, of the removable fluid supply tank of FIG. 1 with a cover removed.
Figure 3:
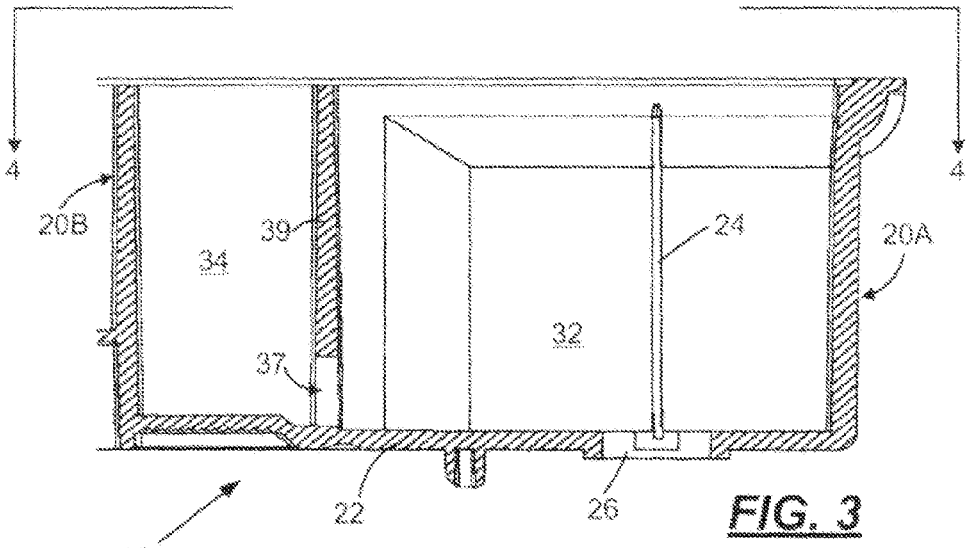
FIG. 3 is a cross-sectional side view, not to scale, of a removable fluid supply tank containing a vent conduit according to an embodiment of the disclosure.
Figure 4:
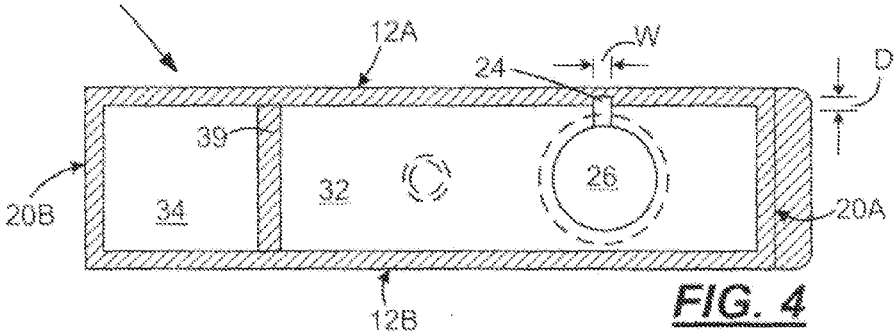
FIG. 4 is a top plan view, not to scale, of an inside of the fluid supply tank of FIG. 3.

With reference to FIG. 1, there is illustrated an exemplary removable fluid supply tank 10 having a body portion 12 and a cover 14. The cover 14 includes a fluid fill port 16 and a serpentine air removal vent path 18. Interior views of the tank 10 are illustrated in FIGS. 2, 3 and 4. As shown, the tank 10 includes side walls 12A and 12B, end walls 20A and 20B and a fluid outlet wall 22. In an exemplary embodiment of the disclosure, one or both of the walls 12A and 12B may contain an internal vent conduit 24 disposed between the fluid outlet wall 22 and the cover 14 (FIG. 1). As described in more detail below, the vent conduit 24 enables air adjacent the fluid outlet wall 22 or in an exit port 26 to flow to the cover 14 for exit through the serpentine vent path 18. The vent conduit 24 may prevent entrapment of air or fluid in the tank's exit port 26.

The fluid supply tank 10 and the cover 14 may be made of a variety of materials including metals and plastics that are resistant to fluids contained in the tank 10. For example, the body 10 may be made of a polymeric material, such as amorphous thermoplastic polyethermide materials available from G. E. Plastics of Huntersville, N.C. under the trade name ULTEM 1010, glass filled thermoplastic polyethylene terephthalate resin materials available from E. I. du Pont de Nemours and Company of Wilmington, Del. under the trade name RYNITE, syndiotactic polystyrene containing glass fiber available from Dow Chemical Company of Midland, Mich. under the trade name QUESTRA, polyphenylene ether/polystyrene alloy resin available from G. E. Plastics under the trade names NORYL SI1 and NORYL 300X and polyamide/polyphenylene ether alloy resin available from G. E. Plastics under the trade name NORYL GTX. A particularly suitable material for making the body 10 is ULTEM 1010 polymer.

Figure 5:
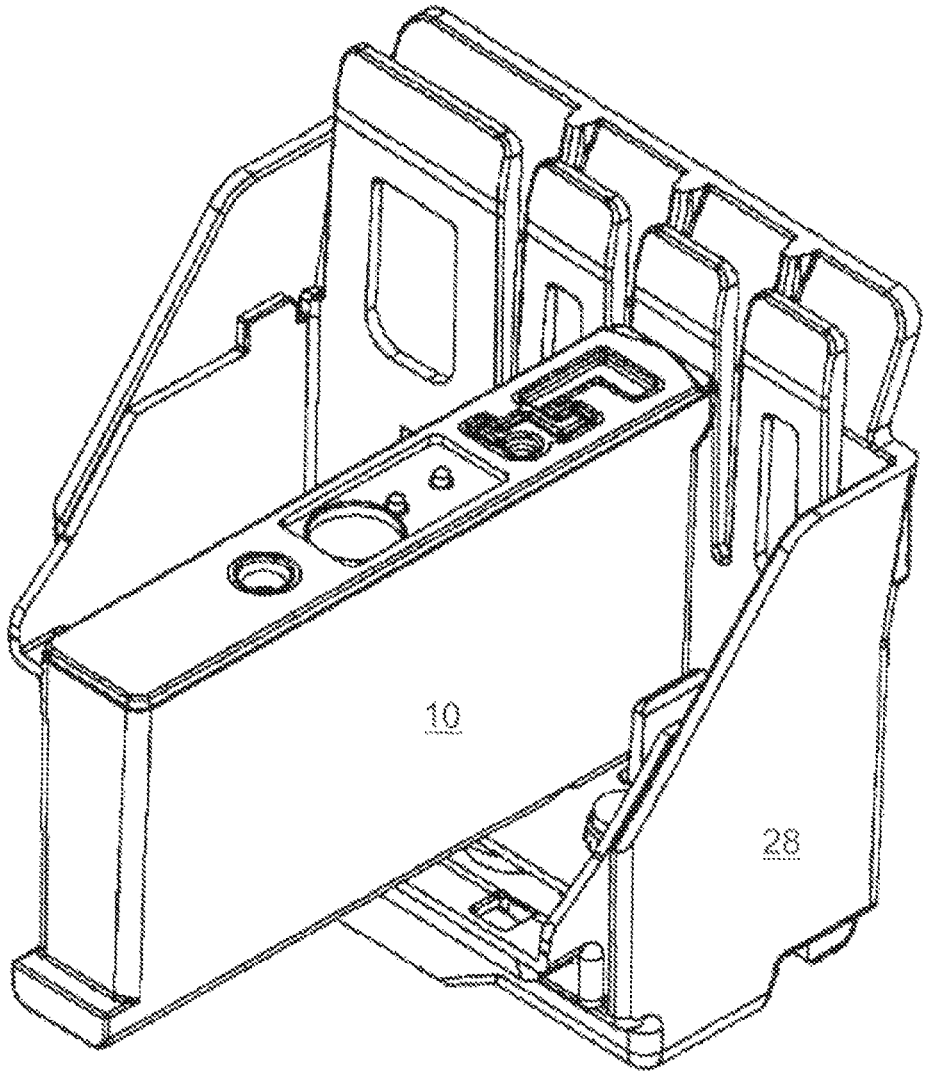
FIG. 5 is a perspective view, not to scale, of a removable fluid supply tank attached to an ejection head structure according to an embodiment of the disclosure.

A micro-fluid ejection device such as an ink jet printer may contain one or more of the removable fluid supply tanks 10. As shown in FIG. 5, each of the removable fluid supply tanks 10 may be attached to an ejection head structure 28 that includes one or more micro-fluid ejection heads 30 (FIG. 6).

Figure 6:
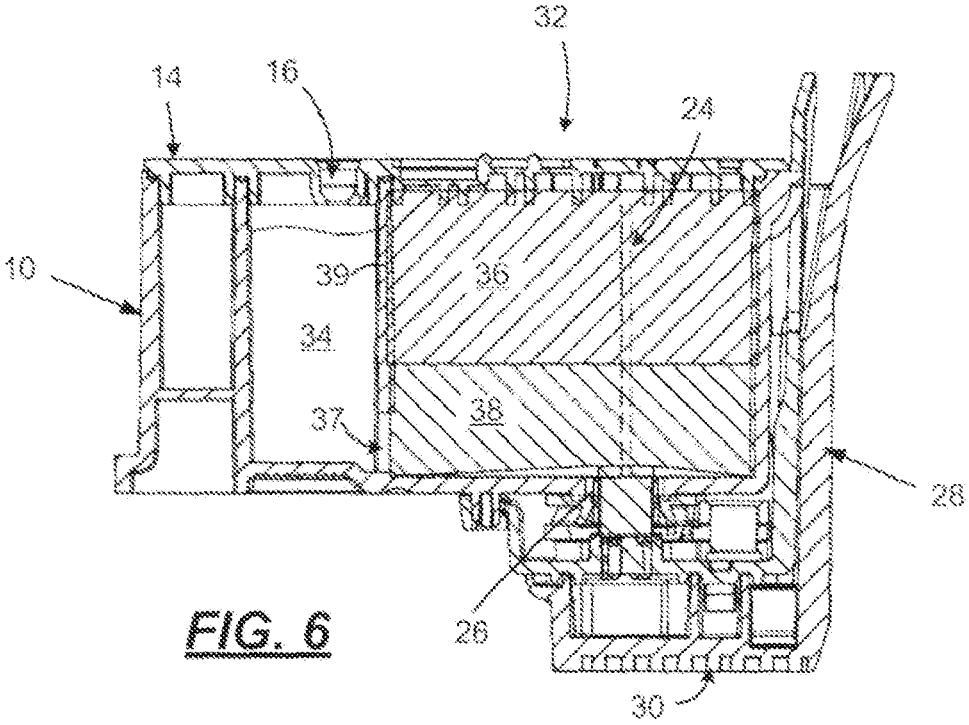
FIG. 6 is a cross-sectional side view, not to scale, of the removable fluid supply tank and ejection head structure of FIG. 5.
Figure 7:
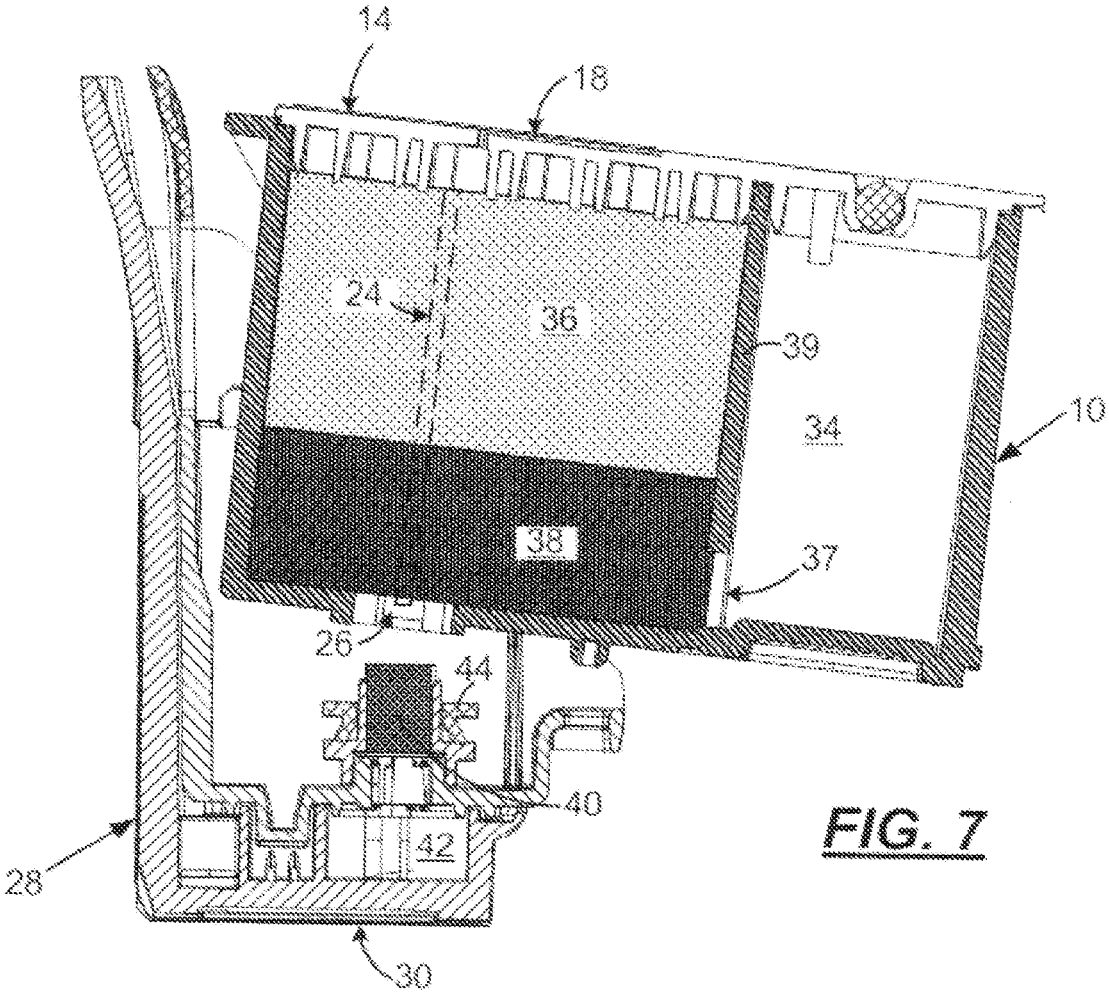
FIG. 7 is a cross-sectional side view, not to scale, of a removable fluid supply tank being attached to an ejection head structure.

A cross-sectional view of the tank 10 is illustrated in FIGS. 6 and 7. The tank 10 may include a fluid capillary section 32 and a liquid section 34. The fluid capillary section 32 may contain one or more felt pads 36 and 38, such as felted foam or other porous absorption members for controllably feeding fluid to the ejection head 30 and for providing negative pressure in the tank 10 to prevent unwanted or unintended flow of fluid from the ejection head 30. For the purposes of this disclosure, a wide variety of negative pressure producing materials may be used to provide controlled fluid flow from the tank 10 to the micro-fluid ejection head 30. Such negative pressure inducing materials may include, but are not limited to, open cell foams, felts, capillary containing materials, absorbent materials, and the like.

As used herein, the terms "foam" and "felt" will be understood to refer generally to reticulated or open cell foams having interconnected void spaces, i.e., porosity and permeability, of desired configuration which enable a fluid to be retained within the foam or felt and to flow therethrough at a desired rate for delivery of fluid to the micro-fluid ejection head 30. Foams and felts of this type are typically polyether-polyurethane materials made by methods well known in the art. A commercially available example of a suitable foam is a felted open cell foam which is a polyurethane material made by the polymerization of a polyol and toluene diisocyanate. The resulting foam is a compressed, reticulated flexible polyester foam made by compressing a foam with both pressure and heat to specified thickness.

Fluid in the pores of the capillary section 32 may be replenished from the liquid section 34 through a path 37 in a partition wall 39 between the capillary section 32 and the liquid section 34. In one embodiment, two different densities of felt pads 36 and 38 are used to provide fluid retention and controlled feeding of fluid to the ejection head 30. For example, the tank 10 may include a low density felt 36 and a medium density felt 38. The felts 36 and 38 hold the fluid and maintain a back pressure on the flow of fluid to the ejection head.

Each time a removable fluid supply tank 10 is attached to an ejection head structure 28, a volume of air in the exit port 26 and air volume displacement in the tank 10 or ejection head 30 is not assured of having a ventilation path to an atmosphere external to the tank 10. In a conventional fluid supply tank, ventilation is not assured because typically the felts 36 and 38 substantially fill the capillary section 32 of the tank 10. However, according to an embodiment of the disclosure, changes in fluid volume or air volume within the tank 10 may travel through the vent conduit 24 to the atmosphere external to the tank 10.

More detail of the ejection head structure 28 is illustrated in FIG. 7. According to one exemplary embodiment of the disclosure, the tank 10 is removable attached to the structure 28 so that the exit port 26 is fluidly connected to a wick 40 for flow of fluid from the tank 10 to a filtered fluid reservoir 42 adjacent to the ejection head 30. A gasket 44 is provided at a connection between the tank 10 and the wick 40 to provide a fluid seal between the tank 10 and wick 40 so that fluid does not leak out of the tank 10 and air is not ingested through the wick 40 or into the tank 20. Also, the gasket 44 reduces exposure of the fluid in the tank 10 to the atmosphere external to the tank which may lead to unwanted evaporation of fluid in the tank 10. The serpentine vent path 18 on the cover 14 provides a vented air path out of the capillary section 32 of the tank 10 without resulting in excessive evaporative loss of fluid from the tank 10.

Figure 8:
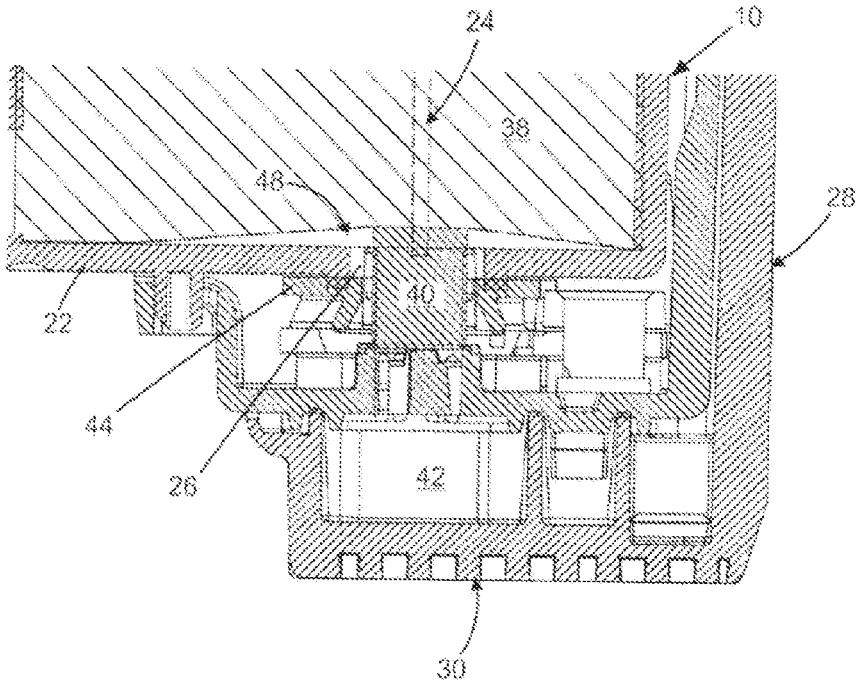
FIG. 8 is an enlarged cross-sectional side view, not to scale, of the removable fluid supply tank removably attached to the ejection head structure of FIG. 7.

FIG. 8 is an enlarged view of the connection between the exit port 26 of the tank 10 and the wick 40. Upon attaching the tank 10 to the wick 40, a depression or air gap 48 may be formed between the outlet wall 22 of the tank and the felt pad 38. Such gap 48 may extend over an entire width of the tank 10 so that it intersects the vent conduit 24 on side wall 12A of the tank 10. Accordingly, there will be air flow communication between the outlet port 26, the gap 48 and the vent conduit 24.

The vent conduit 24 has a size and/or construction that are effective for removing air from the exit port 26 area or the ejection head 30 without substantially filling with fluid. For example, the vent conduit 24 may have a width (W) ranging from about 0.5 to about 2 millimeters and a depth (D) ranging from about 0.5 to about 2 millimeters as shown in FIG. 4. The dimensions of the vent conduit 24 only need to be large enough to provide an air path around the felts 36 and 38 or between the felts 36 and 38 and side wall 12A. Accordingly, the vent conduit 24 need only be large enough to provide a path for air from the exit port 26 and air space adjacent the bottom wall 22 past the felts 36 and 38 to the serpentine vent 18 on the cover 14. The vent conduit 24 may have a variety of cross-sectional shapes including rectangular, triangular, semi-circular, and the like. Also, the vent conduit 24 may be other than a linear path from the bottom wall 22 to the cover 14 and may be provided by an open channel as shown or by tubing disposed in the tank 10 adjacent the side wall 12A and in a channel in the bottom wall 22 connecting the channel in the side wall 12A with the exit port 26 as shown in FIG. 4.

The surface tension of fluid in the tank is a consideration for the dimensions of the width and depth of the vent conduit 24. Fluids having a surface tension similar to the surface tension of water may have vent conduit 24 dimensions having a width (W) of about 1 millimeter and a depth (D) of about 1 millimeter in order to reduce or eliminate wetting of the conduit 24 with the fluid. In an alternative embodiment, the conduit 24 may be made of or coated with a hydrophobic coating material such as polytetrafluoroethylene or polypropylene or polyethylene for aqueous fluids in the tank 10 or may be coated with a hydrophilic coating material such as polyester or polyamide for non-aqueous fluids in the tank 10.

Figure 9:
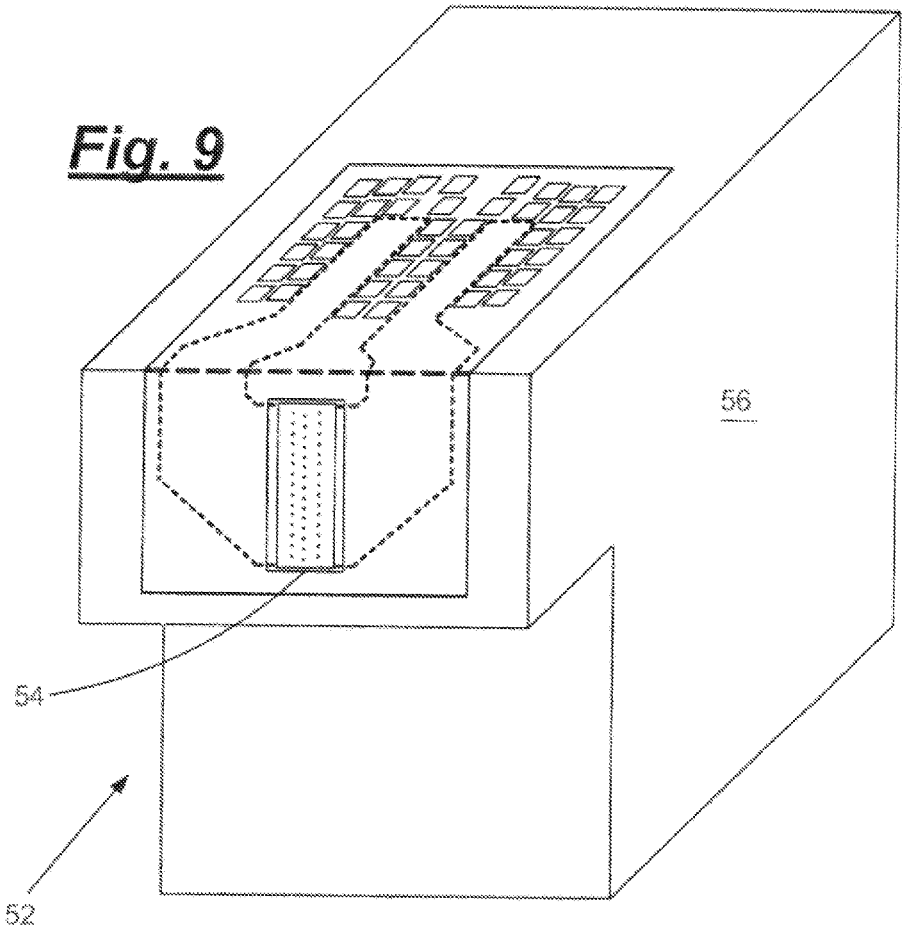
FIG. 9 is a perspective view, not to scale, of a disposable ejection head structure and fluid supply tank according to another embodiment of the disclosure.
Figure 10:
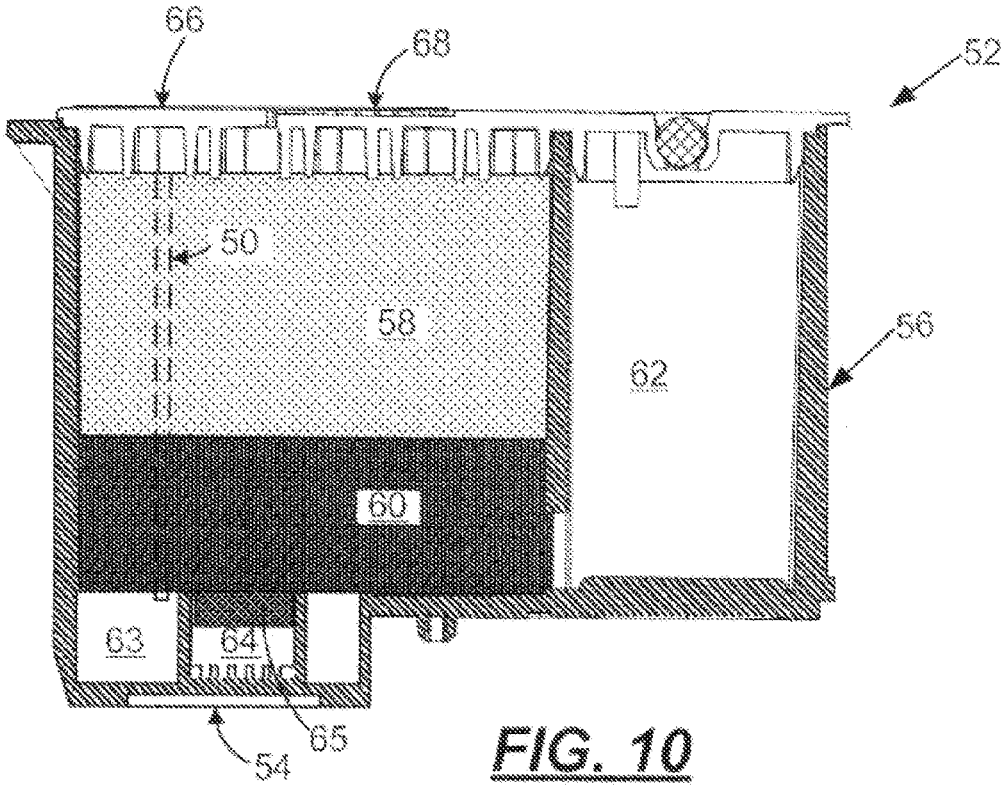
FIG. 10 is a cross-sectional side view, not to scale, of the disposable ejection head structure and fluid supply tank of FIG. 9.

FIGS. 9 and 10 illustrate an alternative embodiment of the disclosure wherein a vent conduit 50 is used with a disposable ejection head and fluid supply tank 52. In this embodiment, an ejection head 54 is fixedly attached to a body 56 containing a fluid to be ejected. As with the previous embodiment, the body 56 may include fluid retention capillary members 58 and 60 and a liquid supply section 62 for replenishing the fluid in the capillary members 58 and 60. In this embodiment, the vent conduit 50 is disposed adjacent a side wall of the body 56 between an air chamber 63 in the ejection head 54 and a cover 66 containing a serpentine air outlet vent 68 as generally described above. Fluid from the capillary member 60 flows through a wick or filter 65 into a filtered fluid chamber 64 for feed to the ejection head 54. In all other respects, the vent conduit 50 may have physical dimensions and characteristics similar to the vent conduit 24 described above.

It is contemplated, and will be apparent to those skilled in the art from the preceding description and the accompanying drawings that modifications and/or changes may be made in the embodiments, disclosed herein. Accordingly, it is expressly intended that the foregoing description and the accompanying drawings are illustrative of exemplary embodiments only, not limiting thereto, and that the true spirit and scope of the disclosed embodiments be determined by reference to the appended claims.

What is claimed is:

1. A fluid supply tank for a micro-fluid ejection head, the fluid supply tank comprising:

a body portion for holding a fluid to be ejected, the body portion having a fluid exit port on an exit end thereof and a cover on an opposing end thereof of the body portion, the cover having an opening in fluid communication with atmosphere;

an internal vent conduit disposed between the exit end and the cover for removing air adjacent to the fluid exit port and releasing the air through the cover to said atmosphere; and an air space in the fluid exit port wherein the internal vent conduit is in air flow communication with the air space and the cover.

2. The fluid supply tank of claim 1, wherein the internal vent conduit comprises a channel disposed in an interior side wall of the fluid supply tank.

3. The fluid supply tank of claim 1, wherein the cover comprises a serpentine vent structure and the internal vent conduit is in air flow communication with the serpentine vent structure.

4. The fluid supply tank of claim 1, wherein the internal vent conduit comprises tubing disposed between the cover and the exit end of the fluid supply tank.

5. The fluid supply tank of claim 1, wherein the fluid supply tank is removably attached to an ejection head structure.

6. The fluid supply tank of claim 1, wherein the internal vent conduit comprises a conduit having cross-sectional dimensions that provide a non-fluid wettable vent channel.

7. The fluid supply tank of claim 1, wherein the internal vent conduit comprises a conduit having a width ranging from about 0.5 to about 2 millimeters and a depth ranging from about 0.5 to about 2 millimeters.

8. The fluid supply tank of claim 1, wherein the internal vent conduit comprises a conduit coated with a hydrophobic coating.

9. The fluid supply tank of claim 1, wherein the internal vent conduit comprises tubing made of a hydrophobic material.

10. A method for enhancing the operation of a micro-fluid ejection device, comprising:

disposing an internal vent conduit in a fluid supply container for the micro-fluid ejection device, wherein the vent conduit is disposed in air flow communication between an air space of a fluid exit end of the container and a container cover opposite the fluid exit end, the container cover having an opening in fluid communication with atmosphere; and installing the fluid supply container on the micro-fluid ejection device so that any trapped air between the container and the device is urged to said atmosphere through the internal vent conduit through an atmospheric vent in the cover.

11. The method of claim 10, wherein the internal vent conduit comprises a channel disposed in an interior side wall of the fluid supply container.

12. The method of claim 10, wherein the atmospheric vent in the cover comprises a serpentine vent structure and the internal vent conduit is in air flow communication with the serpentine vent structure.

13. The method of claim 10, wherein the internal vent conduit comprises tubing disposed between the cover and the fluid exit end of the container.

14. The method of claim 10, wherein the fluid supply container is removably attached to an ejection head structure for the micro-fluid ejection device.

15. The method of claim 10, wherein the internal vent conduit comprises a conduit having cross-sectional dimensions that provide a non-fluid wettable vent channel.

16. The method of claim 10, wherein the internal vent conduit comprises a conduit having a width ranging from about 0.5 to about 2 millimeters and a depth ranging from about 0.5 to about 2 millimeters.

17. The method of claim 10, wherein the internal vent conduit comprises a conduit coated with a hydrophobic coating.

18. The method of claim 10, wherein the internal vent conduit comprises tubing made of a hydrophobic material.

* * * * *